United States Patent [19]

Nakamura

[11] Patent Number: 4,928,403

[45] Date of Patent: May 29, 1990

[54] PLASTIC HEELS OF SHOES AND BOOTS

[75] Inventor: Keizi Nakamura, Chiba, Japan

[73] Assignee: Roman Shoji Co., Ltd.

[21] Appl. No.: 241,857

[22] Filed: Sep. 8, 1988

[30] Foreign Application Priority Data

Feb. 10, 1988 [JP] Japan ..... 63-29832

[51] Int. Cl.[5] ..... A43B 21/00

[52] U.S. Cl. ..... 36/34 A

[58] Field of Search ..... 36/34 A, 84, 87, 32 R, 36/34 R, DIG. 2; 12/147 R, 147 A

[56] References Cited

U.S. PATENT DOCUMENTS 4,229,338 10/1980 Hansen ..... 36/87

FOREIGN PATENT DOCUMENTS 55-56104 4/1980 Japan .

20802 5/1987 Japan ..... 36/84

1124654 8/1968 United Kingdom ..... 36/34 A

*Primary Examiner*—Andrew M. Falk

*Assistant Examiner*—Diana L. Biefeld

*Attorney, Agent, or Firm*—Darby & Darby

[57] ABSTRACT

A plastic heel of shoes or boots decorated with irregular figure on its surface. The irregular figure is a copy of leather or leather-like material. The heel has high quality of appearance and excellence in strength, water resistance and heat resistance so as to extend the life thereof. The costs of producing the heel is reduced by using a metal mold thereof compared with the method for producing a heel by bonding leather or leather-like material to a surface of a heel body one by one.

5 Claims, 3 Drawing Sheets

FIG. 4 (II)

FIG. 4 (III)

FIG. 4 (IV)

FIG. 5(III)
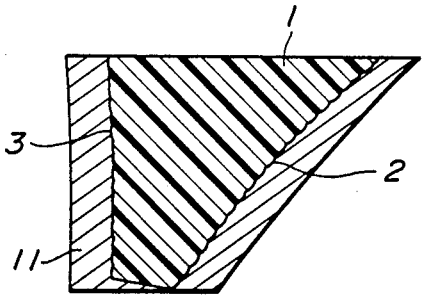

PLASTIC HEELS OF SHOES AND BOOTS

BACKGROUND OF THE INVENTION

The present invention relates to heels of shoes or boots, and more particularly relates to plastic heels of shoes or boots decorated with irregular figures, for example, leather grain like and/or stitching like figures, and processes for producing the same.

When decorating surfaces of plastic heel bodies of shoes or boots with leather or leather-like material, it has been adopted a means for clothing or covering the surfaces of heel bodies with leather naturally produced or artificially synthesized. However, in the conventional means, the heels are decorated by clothing or covering the heel bodies of a predetermined shape with leather or leather-like material, and bonding the leather or leather-like material to the surfaces of the heel bodies one by one.

In the meanwhile, another method for decorating heel surfaces of shoes or boots is disclosed in Japanese Patent Publication No. 58-54805, which comprises pasting a plate on a surface of a heel body, said plate having convex figures or letters, covering an upper surface of the plate with very thin leather or leather-like material, bonding the leather or leather-like material to the upper surface of the plate, and subsequently grinding or polishing the leather or leather-like material to expose the figures or letters and make the surface of the figures or letters flush with the surface of the leather or leather-like material.

However, there have been disadvantages such as low productivity for producing plastic heels decorated with leather or leather-like materials, high costs for producing shoes or boots thus caused, etc., in the conventional means for clothing or covering heel bodies of plastics with leather or leather-like materials since the respective heel bodies must be worked one by one.

In addition, a heel portion is situated or located at one of damageable portions of shoes or boots and thus breakdown or breakage of leather or leather-like material clothing or covering the heel bodies of shoes or boots is significant. As a result, the heel of shoes or boots must be repaired very often. Particularly, in the case of using leathers produced naturally such as kip or calf as clothing or covering materials of heel bodies, abrasions or cuts of the leather or leather-like materials which cover the heel bodies are liable to occur because of the softness thereof. In addition, characteristics such as gloss, elasticity or the like of the surface of the leather naturally produced are lost once poured water on itself. For these reasons, appearances of the heels are hurt.

Furthermore, according to the above second method which comprises pasting a plate on a surface of a heel body, said plate having convex figures or letters on an upper surface thereof, covering an upper surface of the of the plate with very thin leather or leather-like material bonding the leather or leather-like material to the upper surface of the plate, and subsequently grinding or polishing the leather or leather-like material to expose the figures or letters and make the surface of the figures or letters flush with the surface of the leather or leather-like material, high quality of the surface of the leather or leather-like material can not be sufficiently put to practical use since there is a possibility of injuring the surface of the leather or leather-like material at the step of grinding or polishing besides the complexity of the grinding or polishing step and the low productivity of the heels.

The present invention was therefore invented to obviate the various kinds of defects described above.

SUMMARY OF THE INVENTION

An object of the present invention is to provide plastic heels of shoes or boots decorated with irregular figures which have the following characteristics:

(1) appearance completely similar to the heels covered with leather or leather-like material, particularly leather naturally produced without hurting the high quality thereof;

(2) excellence in the strength, water resistance and heat resistance of the surfaces of the heels, and the lives of the heels being greatly extended by preventing breakages such as abrasions or cuts, etc.; and (3) low costs to be worked compared with the conventional one of these types.

Another object of the present invention is to provide processes for producing the plastic heels having the above characteristics.

The first aspect of the present invention is directed to a plastic heel of shoes or boots having irregular figure of plastics on a surface thereof, said irregular figure being a copy of leather or leather-like material, preferably, said irregular figure of plastics being leather grain like figure and/or stitching like figure.

The second aspect of the present invention is directed to a process for producing a plastic heel of shoes or boots having irregular figure of plastics on a surface thereof, said irregular figure being a copy of leather or leather-like material, comprising:

(1) clothing or covering a master model formed in a predetermined heel shape with leather or leather-like material which includes irregular figure on its surface and stitching the shaped leather or leather-like material;

(2) forming a silicone mold having the reversed irregular figure on its inner surface copied from the outer surface of the clothed or covered leather or leather-like material;

(3) forming a gypsum mold having the irregular figure of the leather or leather-like material on its outer surface copied from the silicone mold;

(4) forming a metal mold having the reversed irregular figure of the leather or leather-like material on its inner surface copied from the gypsum mold; and (5) molding the heel of plastics having the irregular figure of the leather or leather-like material on the surface thereof.

The third aspect of the present invention is directed to another process for producing a plastic heel of shoes or boots having irregular figure of plastics on a surface thereof, said irregular figure being a copy of leather or leather-like material, comprising:

(1) clothing or covering a master model formed in a predetermined heel shape with leather or leather-like material which includes irregular figure on its surface and stitching the shaped leather or leather-like material;

(2) coating the surface of the clothed or covered master model with electroconductive material and subjecting the thus treated master model to electroforming treatment to form a metal mold having the reversed irregular figure of the leather or leather-like material on its inner surface; and (3) molding the heel of plastics having the irregular figures of the leather or leather-like material on the surface thereof copied from the metal mold.

According to the present invention, plastic heels of shoes or boots decorated with irregular figures which have the following characteristics;

(1) appearance completely similar to the heels covered with leather or leather-like material, particularly leather naturally produced without hurting the high quality thereof;

(2) excellence in the strength, water resistance and heat resistance of the surfaces of the heels, and the lives of the heels being greatly extended by preventing breakages such as abrasions or cuts, etc.; and (3) low cost to be worked compared with the conventional one of these types; and processes for producing the same can be provided.

DESCRIPTION OF THE DETAILED INVENTION

Figure 1:
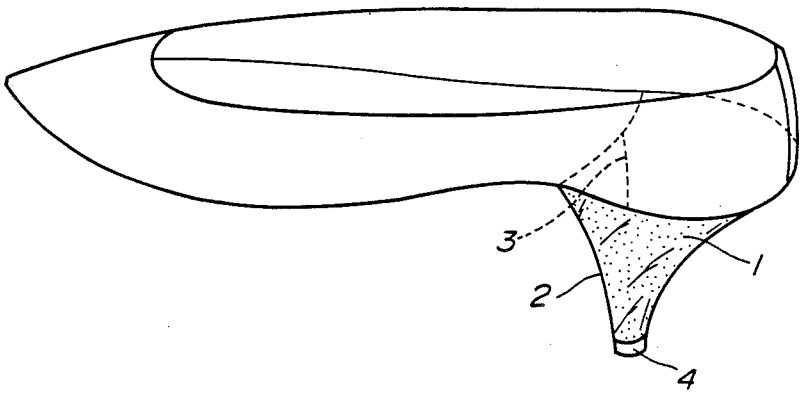
FIG. 1 is a perspective view of a shoe for ladies finished using a heel according to the embodiment of the present invention.

The present invention will be explained in greater details.

In the present invention, thermoset resin such as phenol-formaldehyde resin, phenol-furfural resin, xylene-formaldehyde resin, ketone-formaldehyde resin, urea-formaldehyde resin, melamine-formaldehyde resin, aniline-formaldehyde resin, alkyd resin, unsaturated polyester resin or epoxy resin, thermoplastic such as polyethylene, polypropylene, polystyrene, poly-p-xylene, polyvinyl acetate, polyacrylate, polymethacrylate, polyvinyl chloride, polyvinylide chloride, fluoroplastic, polyacrylonitrile, polyvinyl ether, polyvinyl ketone, polyether, polycarbonate, thermoplastic polyester, polyamide, diene-type plastic, polyurethane type plastic, silicone or inorganic type plastic, or natural plastic such as natural gum type plastic, cellulose type plastic, protein type plastic, or plastic derived from starch may be used as the plastics used for a heel of shoes or boots. However, it is preferred to use the thermoplastic or natural plastic. Particularly, it is preferred to use the polyurethane type plastic and/or natural gum type plastic because the polyurethane type plastic is used for synthetic elastomer and synthetic leather and the natural gum type plastic are commercially wide provided. As the polyurethane type plastic used in the present invention, synthetic elastomer such as BULLCONE, CHEMIGOMU-SL or AJIPRENE C of trademark and synthetic leather such as KORUFAM of the trademark of du Pont Corp. Ltd. or KURARIENO of the trademark of KURALAY Corp. Ltd. are commercially provided. And, as the natural gum type plastic used in the present invention, polyisoprene and chlorinated polyisoprene such as DUROPRENE, ALLOPRENE. DETEL, RAOLIN, PARLON, PARAVER, PRIOCHLOR, TORNESIT, PERGUT, TEGOFAN, DARTEX, PRETEX, CLORTEX or RULACEL of trademark are commercially provided.

In the present invention, the term of "leather" means naturally produced leather such as that of cow, bull, calf, mare, stallion, colt, filly, boar, sow, piglet, goat, kid, ram, ewe or the like, and the term of "leather-like material" mean artificially produced leather such as artificial leather including polyvinyl chloride leather, synthetic leather, simulated synthetic leather substitute or the like. Herein, it is difficult to classify or define the artificial leather, synthetic leather and simulated synthetic substitute. However, they can be, for example, classified as follows depending on the constitutions thereof:

(1) Artificial Leather

Material, in other word, "leathercloth" which has a simple constitution by providing a surface layer of polyvinyl chloride on a support such as woven cloth, knitted cloth, paper or the like and patterning leather like-figure on the surface.

(2) Synthetic Leather

Material which has a constitution by providing "sponge leather" made of foam such as polyvinyl chloride, polyamide, polyurethane on a support such as woven cloth, knitted cloth, paper or the like, and further providing a finished layer made of modified polyamide, polyurethane, polyacrylic acid derivatives, blends of polyamino acids or the like on the upper surface of the "sponge leather", and subsequently patterning the leather-like figure on the finished layer.

(3) Simulated Synthetic Substitute

Modeled material of a naturally produced leather which comprises a substrate layer including a nonwoven fiber binder and a polymer binding material, and a surface layer including a continuous porous structure or comparatively thin layer of polymer compounds, and optionally further comprises an intermediate layer of woven cloth between the substrate layer and the surface layer.

Now processes for producing the plastic heel of shoes or boots according to the present invention will be described in greater detail with reference to the accompanied drawings showing the embodiments thereof.

Figure 2:
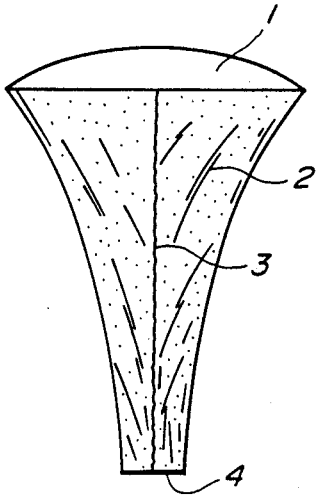
FIG. 2 is a front view of a plastic heel with leather grain like figure and stitching like figure on its surface according to the embodiment of the present invention.
Figure 3:
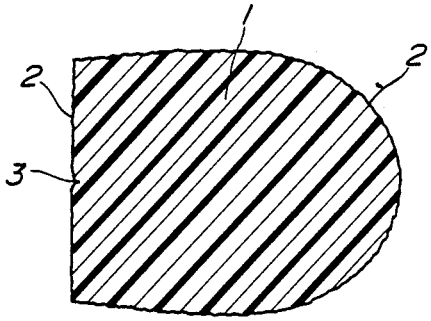
FIG. 3 is a cross-sectional plane view of the plastic heel according to the embodiment of the present invention shown in FIG. 2.

FIG. 1 shows a shoe for ladies finished using a heel according to the embodiment of the present invention. FIGS. 2 and 3 show front and cross-sectional views of a plastic heel according to an embodiment of the present invention, respectively. In these drawings, reference numerals 2 and 3 designate, respectively, leather grain like figure and stitching like figure copied on a surface of a heel made of plastics. These figures are, for example, formed as follows:

At first, a master model 5 which is worked in a predetermined shape is prepared. The material for the master model 5 is not particularly restricted but woods, inorganic materials such as glass, gypsum, carbon materials, ceramics, e.g.,silica, clay, sand, silicon carbide, silicon nitride, metals, metal alloys, plastics or wax may be used therefor. However, the preferable material to be used differs depending on various factors such as processing or working characteristics, durability, pressure resistance, heat resistance, resistance to chemicals, e.g., acids and bases, water resistance, environment resistance or the like thereof. For example, woods are excellent in working characteristics, heat resistance, durability and pressure resistance at normal environment condition while inferior in water resistance, resistance to acid, and particularly inferior in fire resistance. In the case of master model being made of inorganic materials, for example, gypsum or clay, the material can be mixed or kneaded with liquid such as organic and/or inorganic solvents, e.g., water and processed to be a desired shape, and then the shaped material is rendered dry followed by baking. The thus-obtained master model is excellent in heat resistance, pressure resistance, resistance to chemicals, water resistance, environmental resistance, fire resistance while inferior in durability. However, the durability of the material can be improved by selecting ceramic materials, for example, selecting silicon carbide, silicon nitride. When using sand as the material, sand is kneaded with plastic raw materials, particularly thermoset plastic raw materials and, if necessary, adding solvent. Then, the kneaded material is processed to be a desired shape and heated to the hardening temperature of the plastic raw materials. As the thermoset plastic raw materials, commercially provided raw materials for producing thermoset plastics such as phenol resin, urea resin, melamine resin, epoxy resin, unsaturated polyester resin, alkyd resin, silicone resin, ureathane resin, furan resin, polyimide resin, e.g., Nylon (trade mark of du Pont Corp. Ltd.) or the like can be used. The thus-formed master model is excellent in durability, water-insolubility. Furthermore, as the material for the master model, metals or metal alloys may be used. In this case, for example, sand mold casting method is adopted. That is, at first, a negative mold is formed by inserting a positive pattern of the master model into sand. At this time, the positive pattern may be made by working a material such as wood, wax, synthetic resin, e.g., epoxy resin, metal, e.g., aluminum alloy, brass, cast iron, lead alloy, zinc alloy, etc., in a predetermined shape, and the viscosity and strength of the sand may be adjusted by adding binder of synthetic resin. Subsequently, molten raw materials of metal or metal alloy are poured into the thus-formed negative mold and cooled to form a crude master model and then the crude master model is subjected to deburring followed by annealing to form a master model. Incidentally, the master model made of metal or metal alloy may be formed starting from metal or metal alloy ingots by combining various machine works such as cutting, e.g., lathe machining work, drilling machining work, boring machining work, milling machining work, planing machining work, shaping machining work, forging work, component rolling, shear spinning, extrusion, drawing, rolling, shearing or the like.

Figure 4:
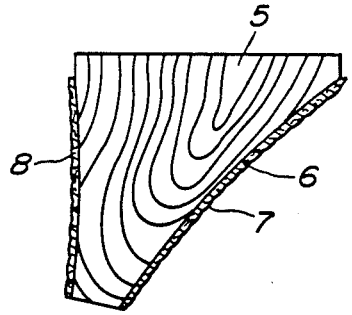
FIGS. 4(I) to 4(V) are schematic views showing a manufacturing process of the present invention using a silicone mold and a gypsum mold.
Figure 4:
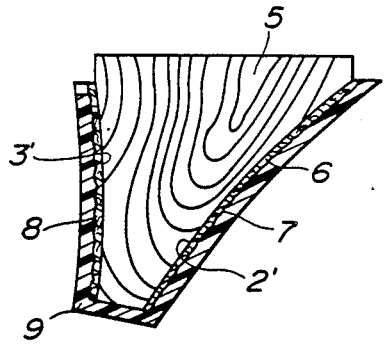
Figure 4:
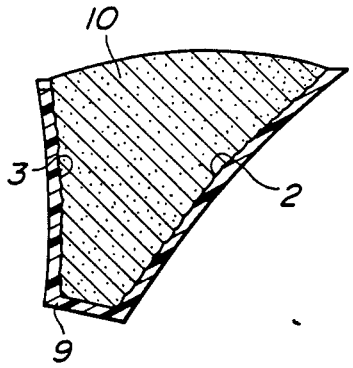
Figure 4:
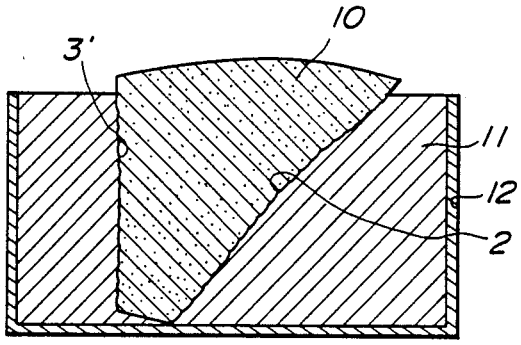
Figure 4:
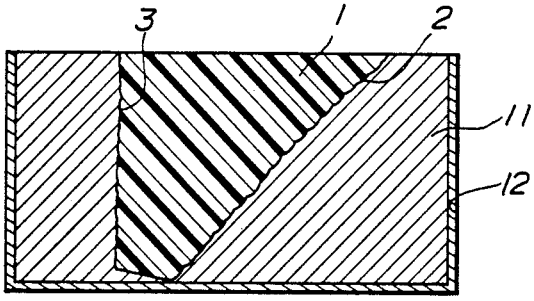

Subsequently, as shown in FIG. 4 (I), the master model produced 5 (In FIG. 4(I) and FIG. 4(II), the master model made of wood is shown.) is subjected to clothing or covering with the leather or leather-like material 6 which includes the desired irregular figure, e.g., grain 7 on its surface and then subjected to stitching the shaped leather or leather-like material to form stitching FIG. 8. At this time, the stitching working is done manually as same as the conventional methods for clothing or covering heel bodies one by one as mentioned hereinbefore.

In the next process, as shown in FIG. 4 (II), the surface of the leather or leather-like material 6 covering or clothing the master model 5 is further subjected to covering with molten silicone agent. At this time, if lubricant such as metal salts of carboxylic acid, amides or esters of carboxylic acid, metal soaps, low molecular weight polyethylene, paraffin wax, silicone oil is applied to the surface of the leather or leather-like material 6 for making film thereon, a silicone mold 9 is released from the master model covered or clothed with leather or leather-like material after adding catalyst and promoter to the molten silicone agent so as to be hardened. And thus, the silicone mold 9 having the reversed irregular grain like FIG. 2' and stitching like FIG. 3' of the leather or leather-like material on its inner surface is obtained.

Subsequently, gypsum mixed with thermoset resin and optionally glass fiber, wire cloth is prepared. Then the gypsum is kneaded with water. Thereafter, as shown in FIG. 4 (III), the thus-kneaded gypsum is poured into the silicone mold 9 and rendered dry, for example, by vacuum molding method and hardened therein to form a gypsum mold 10 having the irregular grain like FIG. 2 and stitching like FIG. 3 on its outer surface. Addition of the thermoset resin, glass fiber or wire cloth serves for reinforcing the strength of the produced gypsum mold 10. And then if the lubricant mentioned hereinbeore is applied to the inner surface of the silicone mold 9 to form a film, the hardened gypsum mold 10 can be released from the silicone mold 9.

Thus, as shown in FIG. 4 (IV), the gypsum mold 10 is supported or stood in a vessel 12 of heat resistant material such as ceramics and then molten metal or molten metal alloy is poured into the vessel 12 to form a metal mold 11 having the reversed irregular grain like FIG. 2' and stitching like FIG. 3' on its inner surface. In this case, it is preferred that the lubricant is applied to the outer irregular surface of the gypsum mold 10 prior to the pouring of the molten metal to render the releasing of the metal mold 11 from the gypsum mold 10 easy. The raw material for the molten metal metal or molten metal is not particularly restricted but aluminum alloy, e.g., duralumin, super duralumin (Alcoa 14S, Alcoa 17S), zinc alloy and zinc-aluminum-tin alloy (ZAS) are preferred because the mold made of these materials does not rust differing from iron, copper, etc. and does not need mechanical strength as is required for a injection mold if the following plastic molding process is performed by vacuum molding method.

Finally, the thus produced metal mold is subjected to mechanical cleaning and pretreated with solvent such as acetone, carbon tetrachloride, methyl alcohol, petroleum ether or the like. Then, the lubricant mentioned hereinbefore is applied to the inner irregular surface of the metal mold 11 to make a film thereon. And then, as shown in FIG. 4 (V), raw materials of the plastics such as raw materials for thermoset resin, raw materials for natural plastic, etc., are put or poured into the metal mold 11 and optionally catalysts are added thereto and is subjected to heating and/or ultraviolet-light irradiation to cure. Thereafter, the crude plastic heel having the grain like figure and stitching like figure on its surface is released from the metal mold 11. The crude plastic heel is rendered to machine work, for example, deburring and finally a finished heel is obtained. If coloring agent is added to the raw materials of the plastics at this plastic molding process, the finished heel can be colored with a desired color and the color of the surface of the finished heel does not come off even if abrasions or cuts occur thereon. On the other hand, the heel can be colored with a desired color after finishing. In this case, heels having the same color can be mass-produced and painting can be done freely as occasion demands.

The second process for producing the plastic heel of shoes or boots according to the present invention will be described in detail with reference to FIGS. 5 (I) to 5 (III).

The feature of this process exists in the use of electroforming method.

That is, as is similar with the above first producing method, a master model 5 which is worked in a predetermined shape is prepared. The material for the master model 5 is not particularly restricted but metal such as brass, soft steel, stainless steel, zinc, aluminum, low-melting metal alloy or nonmetal such as gypsum, wax, glass, woods, plastics may be used therefor.

Figure 5I:
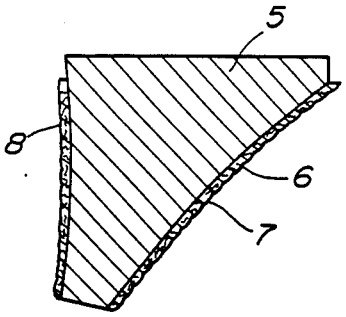
FIGS. 5(I) to 5(III) are schematic views showing another manufacturing process by an electrochemical casting according to the present invention.
Figure 5:
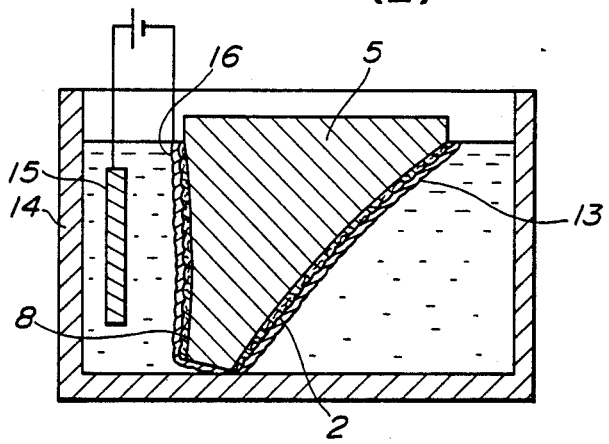

Then, as shown in FIG. 5 (I), the master model 5 (In FIGS. 5(I) and 5(II), the master model made of metal alloy is shown.) subjected to clothing or covering with the leather or leather-like material 6 which includes the desired irregular figure, e.g., grain 7 on its surface and subjected to stitching the shaped leather or leather-like material to form stitching FIG. 8.

Subsequently, the master model clothed or covered with leather or leather-like material is rendered to coating with an elecroconductive material 13. In this case, as the treating method for rendering the clothed or covered master model electroconductive, there exist several methods as follows:

(1) a method for coating the surface of the leather or leather-like material with carbon or electroconductive metal powders;

(2) a method for depositing an electroconductive metal on the surface of leather or leather-like material;

(3) a method using silver mirror reaction, that is, the method comprising cleaning the surface of the leather or leather-like material, dipping the clothed or covered master model into tin dichloride solution containing hydrochloric acid in a predetermined amount for 1 to 5 minutes, washing with water, then silver solution and hydrazine sulfate containing sodium hydroxide solution or formalin solution and washing with water.

In the mean while, an electroforming bath 14 is prepared. As an electroforming metal, Cu, Ni, Fe or Ni-Co alloy are generally used. The general conditions of the electroforming bath of the respective electroformings by Cu, Ni and Fe are as follows:

| | Cu Electroforming Bath | |
|---|---|---|
| | $CuSO_4$ Bath | $Cu(BF_4)_2$ Bath |
| $CuSO_4$ $5H_2O$ (g/l) | 220 to 240 | — |
| $Cu(BF_4)_2$ (g/l) | — | 220 to 450 |
| $H_2SO_4$ (g/l) | 45 to 75 | — |
| $HBF_4$ (g/l) | — | pH 0.3 to 1.4 |
| Temperature (°C.) | 25 to 40 | 25 to 50 |
| Current Density ($Adm^{-1}$) | 2 to 5 | 10 to 30 |

| | Ni Electroforming Bath | | |
|---|---|---|---|
| | $Ni(NH_2SO_3)_2$ Bath | $Ni(BF_4)_2$ Bath | Watts Bath |
| $Ni(NH_2SO_3)_2$ (g/l) | 300 to 450 | — | — |
| $Ni(BF_4)_2$ (g/l) | — | 300 to 450 | — |
| $NiSO_4$ $7H_2O$ (g/l) | — | — | 240 to 330 |
| $NiCl_2$ $6H_2O$ (g/l) | 0 to 15 | — | 38 to 53 |
| $H_3BO_3$ (g/l) | 30 to 45 | 25 to 45 | 30 to 45 |
| pH | 3.5 to 4.5 | 3.0 to 4.0 | 1.5 to 4.0 |
| Temperature (°C.) | 40 to 60 | 40 to 50 | 45 to 60 |
| Current Density ($Adm^{-1}$) | 2.5 to 20 | 2.5 to 10 | 2.5 to 10 |

| | Fe Electroforming Bath | |
|---|---|---|
| | $FeCl_2$ Bath | $Fe(BF_4)_2$ Bath |
| $FeCl_2$ (g/l) | 225 to 450 | — |
| $Fe(BF_4)_2$ (g/l) | — | 150 to 225 |
| $CaCl_2$ (g/l) | 110 to 150 | — |
| NaCl (g/l) | — | 7.5 to 12 |
| pH | 0.15 to 1.5 | 2.7 to 3.0 |
| Temperature (°C.) | 85 to 95 | 55 to 60 |
| Current Density ($Adm^{-1}$) | 2 to 8 | 2 to 10 |

Then, the direct current is applied to the electroforming bath by rendering the high purified electroforming metal anode 15 and the pretreated electroconductive master model cathode 16 with the predetermined current density to deposit a electroformed layer on the surface of the electroconductive master model as shown in FIG. 5 (II). Thereafter, the thus formed electroformed mold 11 is taken off from the elecroconductive master model and optionally the outer surface of the electoformed metal mold 11 is reinforced by spraying molten metal.

Finally, the inner surface of the electroformed metal mold 11 is subjected to mechanical cleaning and pretreated with solvent such as acetone, carbon tetrachloride, methyl alcohol, petroleum ether or the like. Then the lubricant mentioned hereinafter is applied to the inner irregular surface of the electroformed metal mold 11 to make a film thereon. And then, as shown in FIG. 5 (III), raw materials of the plastics such as raw materials for thermoset resin, raw materials for natural plastic, etc., are put or poured into the electroformed metal mold 11 and optionally catalysts are added thereto and is subjected to heating and/or ultravioletlight irradiation to cure. Thereafter, the crude plastic heel having the grain like figure and stitching like figure on its surface is released from the electroformed mold 11. The crude plastic heel is rendered to machine work, for example, deburring and finally a finished heel is obtained. And then as similar with the first producing method, the finished heel can be colored with a desired color if necessary.

While the present invention has been described in its particular embodiments, the scope of the present invention is not restricted to those embodiments but is determined to be solely by the following claims.

What is claimed is:

1. A plastic heel for shoes and boots having an outer surface of plastic material, said outer surface having an irregular figure which is a copy of a leather or leather-like surface, said plastic material comprising a thermoset resin selected from the group consisting essentially of phenol-formaldehyde resin, phenol-furfural resin, xylene-formaldehyde resin, ketone-formaldehyde resin, ureaformaldehyde resin, melamine-formaldehyde resin, anilineformaldehyde resin, alkyd resin, unsaturated polyester resin, and unsaturated epoxy resin; a thermoplastic resin selected from the group consisting essentially of polyethylene, polypropylene, polystyrene, poly-p-xylene, polyvinyl acetate, polyacrylate, polymethacrylate, polyvinyl chloride, polyvinylidene chloride, fluoroplastic, polyacrylonitrile, polyvinyl ether, polyvinyl ketone, polyether, polycarbonate, thermoplastic polyester, polyamide, diene-type plastic, polyurethane, and silicon; and a natural plastic selected from the group consisting essentially of natural gum, cellulose, protein and starch.

2. The plastic heel of claim 1, wherein said irregular figure is a leather grain.

3. The plastic heel of claim 1, wherein the irregular figure is a stitching figure.

4. The plastic heel of claim 1, wherein said plastic material has a coloring agent uniformly mixed therein.

5. The plastic heel of claim 4, wherein the heel maintains its color when subject to cuts and abrasion.

* * * * *